US006581360B1

(12) United States Patent
Hirsh et al.

(10) Patent No.: US 6,581,360 B1
(45) Date of Patent: Jun. 24, 2003

(54) PACKAGING MACHINERY

(75) Inventors: Ivan Yehudi Hirsh, Bucks (GB); Malcolm Charles Kerry, Beeston (GB); David Robert Seaward, Hallaway (GB); Peter John Whitlock, Coventry (GB)

(73) Assignee: Molins PLC, Milton Keynes (GB)

( * ) Notice: Subject to any disclaimer, the term of this patent is extended or adjusted under 35 U.S.C. 154(b) by 0 days.

(21) Appl. No.: 09/381,503

(22) PCT Filed: Mar. 23, 1998

(86) PCT No.: PCT/GB98/00882

§ 371 (c)(1),
(2), (4) Date: Sep. 21, 1999

(87) PCT Pub. No.: WO98/42576

PCT Pub. Date: Oct. 1, 1998

(30) Foreign Application Priority Data

Mar. 21, 1997 (GB) ..... 9705948
Sep. 24, 1997 (GB) ..... 9720200

(51) Int. Cl.[7] ..... B65B 9/06
(52) U.S. Cl. ..... 53/551
(58) Field of Search ..... 53/451, 551, 552, 53/526, 527, 528, 370.7

(56) References Cited

U.S. PATENT DOCUMENTS

| | | | | |
|---|---|---|---|---|
| 2,915,866 A | | 12/1959 | Bartlo | |
| 2,956,383 A | * | 10/1960 | Gausman | 53/526 |
| 3,070,931 A | | 1/1963 | Zwight | |
| 3,262,244 A | | 7/1966 | Cutler et al. | |
| 3,668,815 A | | 6/1972 | Henry et al. | |
| 3,849,965 A | | 11/1974 | Dominici | |
| 4,074,504 A | * | 2/1978 | Greenawalt et al. | 53/22 A |
| 4,663,917 A | * | 5/1987 | Taylor et al. | 53/552 |
| 4,750,313 A | * | 6/1988 | Kammler et al. | 53/451 |
| 4,757,688 A | | 7/1988 | Basulis et al. | |
| 4,947,618 A | | 8/1990 | Schneider et al. | |
| 5,031,386 A | * | 7/1991 | Schneider | 53/551 |
| 5,203,145 A | | 4/1993 | Kammler et al. | |
| 5,279,098 A | | 1/1994 | Fukuda | |
| 5,412,927 A | | 5/1995 | Miyazaki et al. | |
| 5,533,322 A | * | 7/1996 | Bacon et al. | 53/451 |
| 5,575,137 A | | 11/1996 | Metz et al. | |
| 5,881,539 A | * | 3/1999 | Fukuda et al. | 53/526 |

FOREIGN PATENT DOCUMENTS

| | | |
|---|---|---|
| EP | 0488794 A2 | 6/1992 |
| EP | 0718195 A1 | 6/1996 |
| EP | 0718196 A1 | 6/1996 |
| GB | 2179620 | 3/1987 |

* cited by examiner

*Primary Examiner*—Stephen F. Gerrity
*Assistant Examiner*—John Paradiso
(74) *Attorney, Agent, or Firm*—Antonelli, Terry, Stout & Kraus, LLP

(57) ABSTRACT

A vertical form, fill and seal (VFFS) packaging machine comprising a pair of sealing jaws (12; 100; 200, 202; 302, 304) mounted directly or indirectly on parallel shafts (10; 102; 206, 208; 300) for rotation in opposite directions on opposite sides of the path of the packaging material (36; 118; 204, 308) so that the jaws engage the packaging material simultaneously on opposite sides to form successive horizontal seals, and stripping means comprising, in association with the sealing jaw on each side of the path of the packaging material, a pair of stripper carriers (22; 54; 66; 116; 222, 224, 226, 228; 314) mounted for rotation around the corresponding shaft at or near the respective ends thereof, or about an axis parallel to the shaft, a horizontal stripper bar (18B; 40A; 50A; 62; 110; 234; 310) mounted at its respective ends on the two stripper carriers and arranged to be movable with respect to the stripper carriers so that the stripper bar can engage the packaging film along a predetermined vertical stripping path along which, in cooperation with a similar stripper bar associated with the sealing jaw on the other side of the packaging material, it acts to displace downwards any product which might otherwise be trapped in the area of the seal, the stripper carriers being arranged to be rotated faster than the shafts at least while the stripper bars are performing each stripping operation.

17 Claims, 8 Drawing Sheets

PACKAGING MACHINERY

This invention is concerned particularly with packaging machines commonly referred to as vertical form fill and seal (VFFS) machines. It will be described specifically with reference to such machines, but it should be understood that at least certain aspects of this invention are applicable to machines in which the packaging material moves obliquely downwards or even horizontally while bags are being formed. All such machines are encompassed in this context by the expression "machines of the type described".

In a VFFS machine, a web of packaging material is drawn along a former and then passes downwards in tubular formation; the edges are sealed longitudinally as the packaging material moves downwards (assuming, as is preferred, that the packaging material moves continuously), after which horizontal seals are made at regular intervals to form individual bags. A measured quantity of product to be packaged is dropped into each bag before a top seal is formed by sealing jaws which simultaneously form the bottom seal of the next bag. The sealing jaws commonly include a cutting device which separates successive bags.

With some materials and in some circumstances, it is desirable to provide a stripping device to ensure that each measured quantity of the product passes downwards reliably into its bag before the top seal is formed. Examples of stripping devices are described in European patent No.165819 and U.S. Pat. Nos. 2,915,866, 3,070,931, 3,256,673 and 3,262,244. A further example of a stripping device is described in our patent application WO96/32328. The present invention is concerned particularly with new forms of stripping devices for packaging machines of this general type.

According to one aspect of this invention, a packaging machine of the type described, for forming downwardly moving packaging material into bags containing product, comprises a pair of sealing jaws mounted directly or indirectly on parallel shafts for rotation in opposite directions on opposite sides of the path of the packaging material so that the jaws engage the packaging material simultaneously on opposite sides to form successive horizontal seals (or alternate seals if there are, for example, two jaws on each shaft), and stripping means comprising, in association with the sealing jaw on each side of the path of the packaging material, a pair of stripper carriers mounted for rotation around the corresponding shaft at or near the respective ends thereof, or about an axis parallel to the shaft, a horizontal stripper bar mounted at its respective ends on the two stripper carriers and arranged to be movable with respect to the stripper carriers so that the stripper bar can engage the packaging film along a predetermined vertical stripping path along which, in cooperation with a similar stripper bar associated with the sealing jaw on the other side of the packaging material, it acts to displace downwards any product which might otherwise be trapped in the area of the seal, the stripper carriers being arranged to be rotated faster than the shafts at least while the stripper bars are performing each stripping operation.

The stripper carriers are preferably driven by a servo motor separate from the motor driving the shafts, which latter motor may also be a servo motor. In this context by "servo motor" we mean a motor of which the output shaft is electronically timed and controlled as to its speed. By this means, the stripper bars can be arranged be driven faster than the sealing jaws while performing each stripping operation; however, if the number of stripper bars equals the number of sealing jaws, for example, then the average speed of the stripper bars would equal that of the sealing jaws. It should be noted, however, that the sealing jaws may be driven at a cyclically varying speed in order to produce the required bag length which may vary for different products; accordingly, as mentioned above, what is important is that the stripper bars should move faster than the sealing jaws so as to overtake them while performing each stripping operation, whatever the speed of the sealing jaws happens to be.

The speed of the jaws, while creating each seal, would normally be equal to the speed of the packaging material which may also be variable as a result of being driven by yet another servo motor.

Instead of the stripper bars being driven by an independent servo motor, they may receive their drive from the motor driving the sealing jaws, for example via a gear train or other mechanism whereby the speed of the stripper bars is arranged to fluctuate cyclically, for example sinusoidally or approximately so, with respect to the speed of the jaws. By this means, a stripper bar could overtake the corresponding sealing jaw to perform each stripping operation, and then slow down to allow the jaw to overtake it in preparation for the next stripping operation. This modification, which constitutes an alternative aspect of this invention, may also be applied to belt or chain mounted stripper bars as described in our patent application WO96/32328.

Alternatively, a common servo motor may be used to drive the sealing jaws and the strippers if, for example, there are two pairs of sealing jaws with a single stripper (on each side of the packaging material) which is driven at a speed exactly twice that of the sealing jaws.

Each stripper bar may be pivotally mounted on its corresponding stripper carriers so that the part of the stripper bar which contacts the packaging material during each stripping operation can move vertically through a predetermined distance, in contact with the packaging material, while overtaking the jaw and performing each stripping operation. One or more springs may be provided to urge the stripper bar into contact with the packaging material with a controlled force. Alternatively, each stripper bar may be controlled as to its angular position with respect to the stripper carriers by means of one or more cams. Another possibility is that each stripper bar may be mounted on its stripper carriers via leaf springs.

According to another aspect of this invention, a packaging machine of the type described comprises a pair of cooperating sealing devices mounted directly or indirectly on parallel shafts for rotation in opposite directions on opposite sides of the path of the packaging material so that the sealing devices engage the packaging material simultaneously on opposite sides to form successive horizontal seals, each sealing device comprising two oppositely disposed sealing jaws whereby two seals are formed during each revolution of the shaft; and stripping means comprising a pair of cooperating stripper bars for engaging opposite sides of the packaging material, each stripper bar being carried at its ends by arms which are pivotally or otherwise movably mounted on rotary stripper carrying members lying beyond the ends of the sealing jaws and being driven at an average or set speed twice that of the shaft, whereby the stripping means strips downwards any product lying within the packaging material, in each region about to be sealed, in advance of each pair of sealing jaws engaging the packaging material, the pivotal or other movement of the arms being such as to allow the stripper bars to move past the sealing jaws in order to perform the stripping operations.

The shaft is preferably driven by a servo motor capable of varying the shaft speed as may be necessary, for example in order to form bags of different lengths. The stripper carriers may be driven by a separate servo motor at an average speed twice that of the shaft; or alternatively, the stripper carriers may be driven by the servo motor driving the shaft but via a transmission which doubles the speed of the stripper carriers relative to the shaft.

The arms carrying each stripper bar may be pivotally mounted on the respective stripper carriers or may alternatively be telescopically mounted so as to slide in a linear bearing or other guide in order to enable the stripper bar to move to different distances from the axis of rotation of the stripper carriers. In either case, the stripper bar is preferably urged outwards by one or more springs, but may alternatively be controlled as to its position by a cam slideway.

According to another aspect of this invention a packaging machine of the type described comprises one or more (preferably a pair) of sealing devices arranged to engage opposite sides of the packaging material tube to produce transverse seals at regular intervals, each sealing device being continuously driven for movement along a closed path; and a pair of stripping devices arranged to engage opposite sides of the packaging material tube to strip downwards any product contained within the tube in the area about to be sealed by the sealing devices; each stripping device comprising a stripper bar carried at its ends by arms which are movably mounted on stripper carriers located near the ends of the corresponding sealing device, whereby movement of the arms relative to the stripper carriers causes or allows each bar to move outwards away from the axis of rotation so as to clear and thus be able to move past the corresponding sealing device so as to perform a stripping operation in advance of engagement of the sealing device with the packaging material, the stripper carrier being driven at a rotational speed such as to cause the stripper to have a speed greater than the sealing device at least while passing the sealing device and performing a stripping operation.

Examples of different forms of machine according to this invention are shown diagrammatically in the accompanying drawings. In these drawings.

Figure 1:
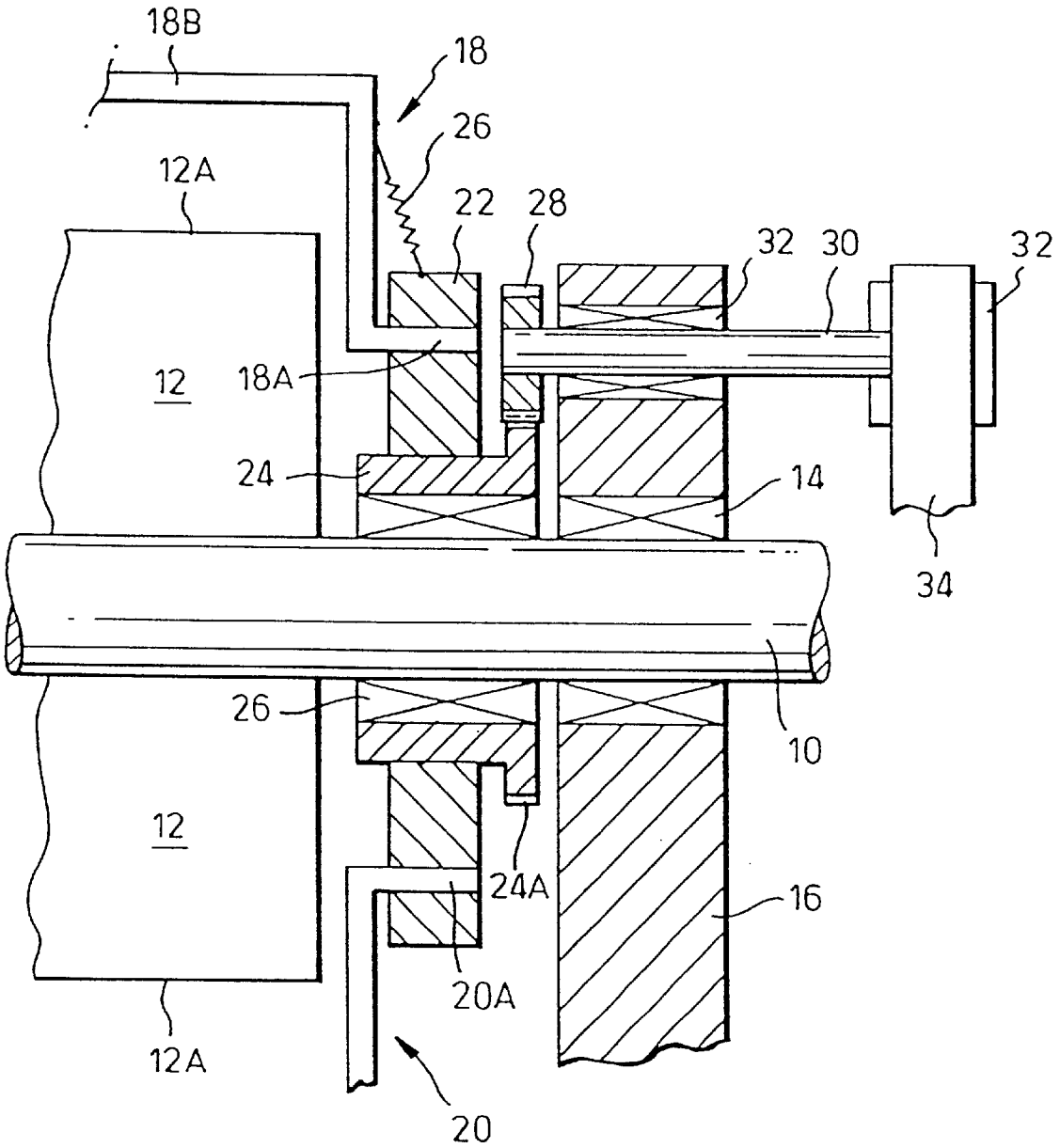
FIG. 1 is a partly sectioned view of part of one machine.

FIG. 1 shows in section the parts located at one end of a shaft carrying a pair of oppositely disposed sealing jaws 12 of which outer surfaces 12A will cooperate with a similar sealing jaw arrangement on the other side of the downwardly moving packaging material (not shown here, but see FIG. 2) to perform horizontal sealing operations on the packaging material. The jaws may also, as is common, include cooperating cutting arrangements for cutting the packaging material horizontally along the mid-region of each seal so as to simultaneously separate the bags.

The shaft 10 is mounted at one end in bearings 14 in a side frame 16. The other end of the shaft is similarly mounted in another side frame. In the region of that other side frame the mechanism may be virtually an exact mirror image of the arrangement shown in FIG. 1.

Two oppositely disposed stripper members 18 and 20 are pivotally mounted at each end (only one end being shown in FIG. 1) on a stripper carrier 22 which is mounted on a sleeve 24 rotatable around the shaft 10 with the aid of a bearing 26. Each stripper member has an inner end portion 18A, 20A which is parallel to the axis of the shaft 10 and is rotatable in the member 22.

As shown in connection with the stripper member 18, the active portion 18B, comprises a bar parallel to the axis of the shaft 10, this portion of the stripper being arranged to engage the packaging material and to perform stripping operations in cooperation with a similar stripping member on the other side of the packaging material. A spring 26 for urging the stripping member against the packaging material is shown diagrammatically in FIG. 1 in relation to the stripping member 18, the same arrangement being provided for the stripping member 20.

One end of the sleeve 24 adjacent to the side frame 16 carries a gear 24A which meshes with a gear 28 fixed to a shaft 30 which is parallel to the shaft 10 and is rotatable in a bearing 32 in the side frame 16. At its outer end the shaft 30 carries a pulley 32 which is driven by a timing belt 34 passing also around a pulley on a drive shaft (not shown) which extends across the machine (parallel to the shaft 10) so as to drive the stripper carrier at the other end of the shaft 10 in the same way. As will be understood, the shaft driving the belt 34 is preferably, as mentioned above, driven by a servo motor separate from the motor (preferably also a servo motor) driving the shaft 10.

In place of the belt 34 and pulley 32 it is possible to use a chain and sprocket arrangement.

Figure 2:
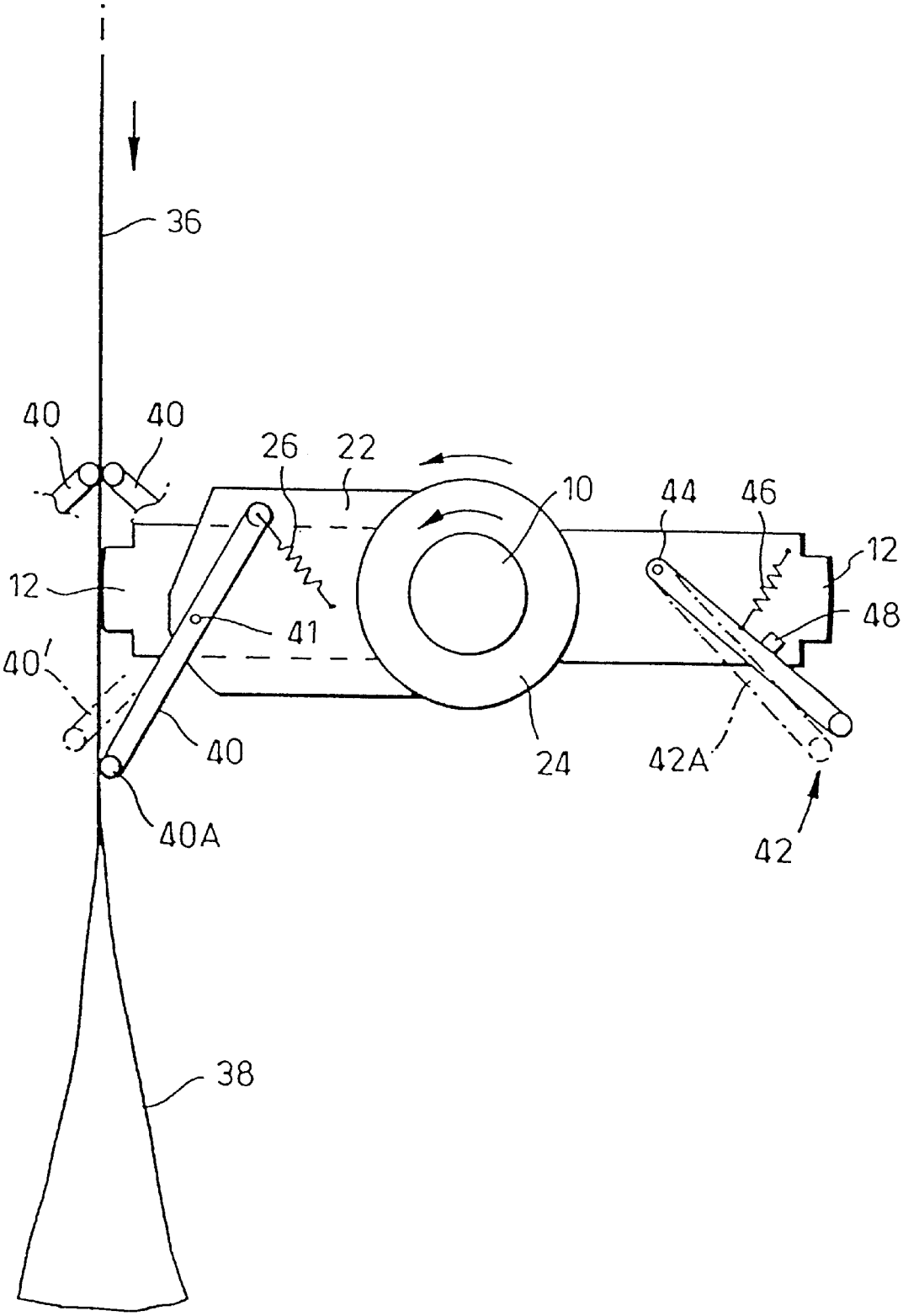
FIGS. 2 to 4 are diagrammatic representations of three different forms of machine.

FIG. 2 shows diagrammatically an arrangement similar to FIG. 1, viewed in the direction of the axis of the shaft 10. It shows the apparatus at the stage of forming a horizontal seal across packaging material 36 to complete one bag 38 while forming the bottom sealed edge of the next bag. The jaws 12 at this stage extend horizontally, and it will be understood that there is a similar piece of apparatus on the other side of the packaging material 36. Thus the jaws, which are heated, cooperate to form each horizontal seal.

FIG. 2 shows only one stripping member 40 which is pivoted at 41 to the radially extending stripper carrier 22. The spring 26 is shown anchored at one end to the stripper carrier 22 and at the other end to the stripping member so as to urge the stripping member in a clockwise direction about the pivot 41 Thus the horizontal bar portion of the stripping member (corresponding to the part 18B in FIG. 1) is pressed against the packaging material. It will be understood that, shortly before the stage shown in FIG. 2, the stripping member lagged behind the jaw 12, and that its greater speed resulted in it overtaking the jaw 12 while performing a stripping operation in cooperation with a similar stripping member on the other side of the packaging material.

When the stripping member is away from the packaging material, it is free to rotate about the pivot 41, relative to the stripper carrier 22, to the position shown in chain dotted outline 41' under the influence of the spring 26.

As shown also in FIG. 2, each sealing jaw may carry a pivoted clamp 42 (only one of which is shown complete, albeit diagrammatically) pivotally mounted at 44 on the jaw. A spring 46 acting between the jaw and the clamp normally, while the clamp is remote from the packaging material, holds the clamp against a stop 48. When the outer end of the clamp (which also comprises a horizontal bar extending right across the packaging material similarly to the stripper member) engages the packaging material and cooperates with a similar clamp on the other side of the packaging material, it swings against the action of the spring to approximately the position shown in chain dotted outline 42A.

The purpose of the clamps is to prevent product from dropping into the region of the seal just as the seal is about to be formed.

FIG. 2 shows, for convenience, only one stripper member. In practice there may be two diametrically opposite to one another for cooperating with the respective jaws 12, as shown in FIG. 1. Preferably, however, the arrangement operates with only one stripper driven about the axis of the shaft 10 at twice the speed (or an average of twice) of the shaft 10. Another possibility is that there could be, for example, three strippers spaced apart by 120° about the axis of the shaft 10; in that case the member 24 carrying the strippers would rotate at an average speed equal to two thirds that of the shaft 10, though again the strippers would need to move faster than the jaws while performing each stripping operation. Other possibilities are, for example, that there could be three or four equally spaced sealing jaws on each shaft, with a similar or smaller number of strippers.

It will be understood that the speed and timing with which the stripper members approach the packaging material should be such that their horizontal bar portions reach the packaging material (above the region of the forthcoming seal) and move along it, past the clamp and jaw, before both the clamp and the jaw reach the packaging material. With that objective, the outmost positions of the clamps (set by the stop 48 in the example shown in FIG. 2) need to be determined accordingly.

The stripping and clamping bars are parallel to the shaft axes, as described above, and are preferably straight. Alternatively, either or both may be slightly outwardly bowed so as to ensure adequate contact pressure against the packaging material in their middle regions.

The clamps, by virtue of their geometry (including their pivot positions), may move upwards relative to the packaging material when they first contact the packaging material and thus perform a slight upward stripping action.

Figure 3:
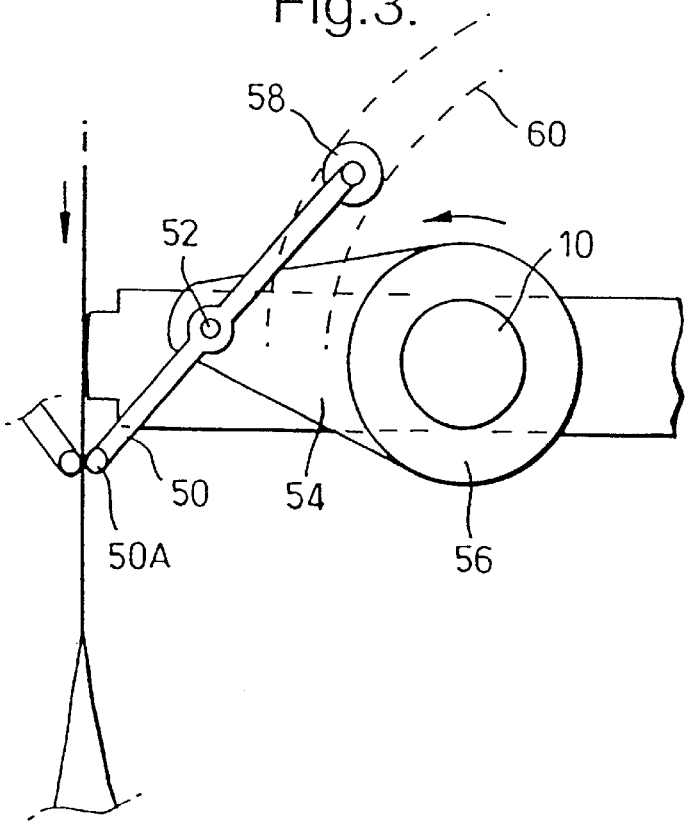
Figure 4:
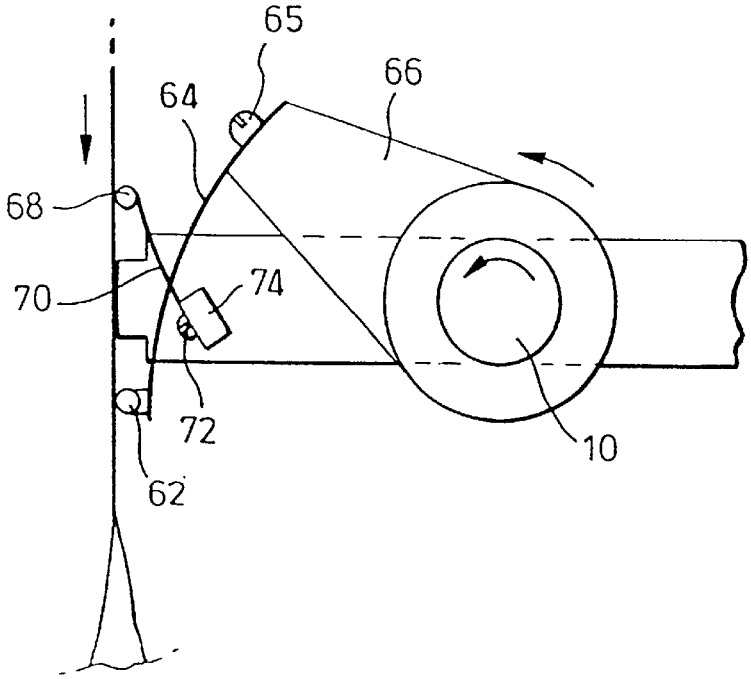

FIGS. 3 and 4 show further alternatives. FIG. 3 shows an arrangement in which the or each stripper member 50 is pivotally mounted at 52 to a carrier 54 on a member 56 rotating with respect to the shaft 10. However, instead of the horizontal bar portion 50A of the stripper member being urged towards the packaging material by a spring, in this example it is controlled by a cam. Specifically, in the example shown, the inner end of the stripper member carries a roller 58 which runs in a groove-like cam track 60 which may be formed in or mounted on the side frame 16 shown in FIG. 1. As before, a similar arrangement exists at the other end of the shaft 10.

FIG. 4 shows an alternative arrangement in which the or each stripper member 62 is mounted at its opposite ends via leaf springs 64 and screws 65 so as to be resiliently movable relative to a stripper carrier 66; each leaf spring may be straight when in the unstressed state, and flexes (as shown) while urging the stripper member against the packaging material. Also, in this example, each jaw carries a clamp 68 which is similarly mounted at its opposite ends via leaf springs 70; the inner end of each leaf spring is secured by one or more screws 72 to a projection 74 on the corresponding jaw.

With each of the above-described arrangements, the stripper drive is preferably independent of that for the sealing jaw or jaws. Moreover, each arrangement may be so constructed that the drive to the strippers can be stopped in the event of a product being packed which does not call for stripping. If, as mentioned above, the stripper drive is derived from the motor driving the jaws, the drive to the stripper or strippers can also be stopped by means of a clutch when necessary.

The arrangements described above are based on sealing jaws moving with a purely rotary motion. Alternatively, each sealing jaw may be mounted on the shaft 10 via an arrangement which allows or causes the jaw to remain in a fixed orientation at least while it is engaging the packaging material, which condition may occur along a predetermined distance, rather than instantaneously as in the case of a purely rotary sealing jaw. Such sealing jaws are commonly referred to as D-motion jaws because the locus of each jaw is D-shaped.

FIGS. 5 to 8 show diagrammatically different stages in the rotation of a different form of machine according to this invention.

The machine comprises a sealing device 100 which includes oppositely disposed sealing jaws 100A and 100B and is rotatable about an axis 102. Associated with each of the sealing jaws is a horizontal product clamping roller or bar 104, only one of which is shown. The clamping roller is parallel to the axis 102 and extends beyond both ends of the sealing device 100, being carried at its respective ends by two arms 106 pivotally mounted on the sealing device by pins 108.

A stripper bar 110 is likewise carried at its respective ends by arms 112 which are pivoted by pins 114 to respective stripper carriers which are shown diagrammatically as arms 116. The arms 116 rotate about the axis 102 at twice the speed of the sealing device 100.

FIGS. 5 to 8 show the sealing and stripping arrangement on one side of a downwardly moving flattened tube of packaging material 118. It will be understood that a similar sealing and stripping arrangement is provided on the left-hand side of the packaging material 118, so that the stripper bars and clamping rollers on opposite sides of the packaging material co-operate with one another to perform the required stripping and clamping functions, and likewise the sealing jaws on opposite sides of the packaging material co-operate to produce horizontal seals at regular intervals along the packaging material. The sealing jaws also include cutting means 100C for cutting the packaging film horizontally so as to separate the successively formed filled bags.

It will be understood that the stripper bar and the clamping roller are urged towards the packaging material by suitable springs (not shown).

Figure 5:
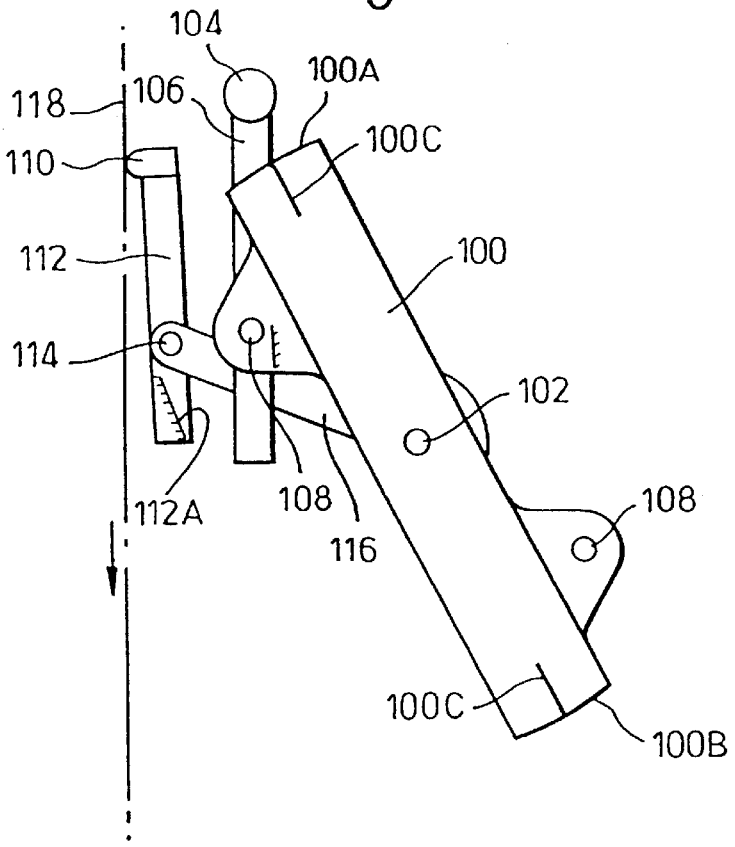
FIGS. 5 to 8 are diagrammatic representations of another different form of machine at different stages in its operation.

FIG. 5 shows the arrangement at a stage shortly after the stripper bar 110 has begun to move along the packaging material so as to strip downwards any product contained within the packaging material in that area. Shortly before this stage, the stripper bar, while in a further extended position under the urging of the spring or springs, (with a stop 112A engaging the arm 116) was able to pass the clamping roller 104 (shown in its limiting outward position) and also the sealing jaw 100A which is about to make a seal.

Figure 6:
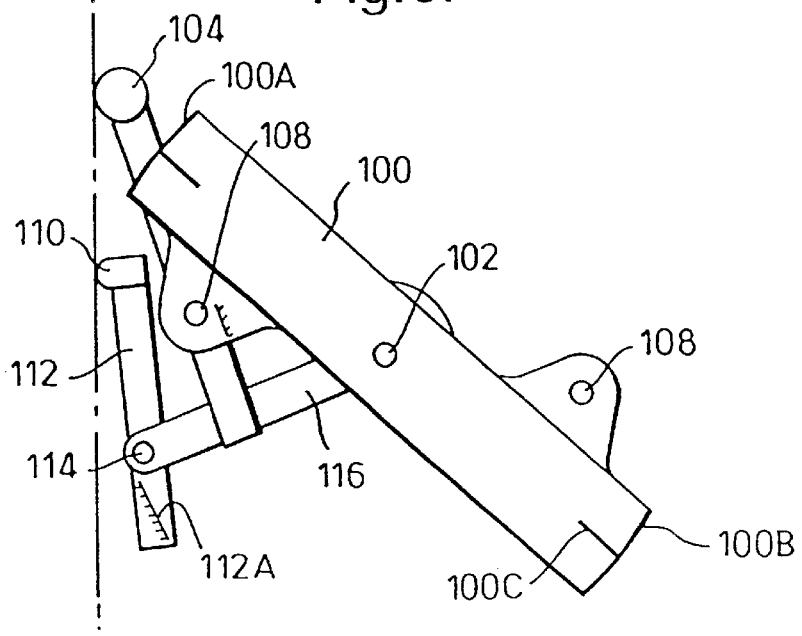

FIG. 6 shows the arrangement after 20° of further rotation of the sealing member 100 and 40° of further rotation of the stripper. At this stage, the clamping rollers 104 on opposite sides of the packaging material begin to cooperate to prevent any product falling downwards past them and into the region about to be sealed.

Figure 7:
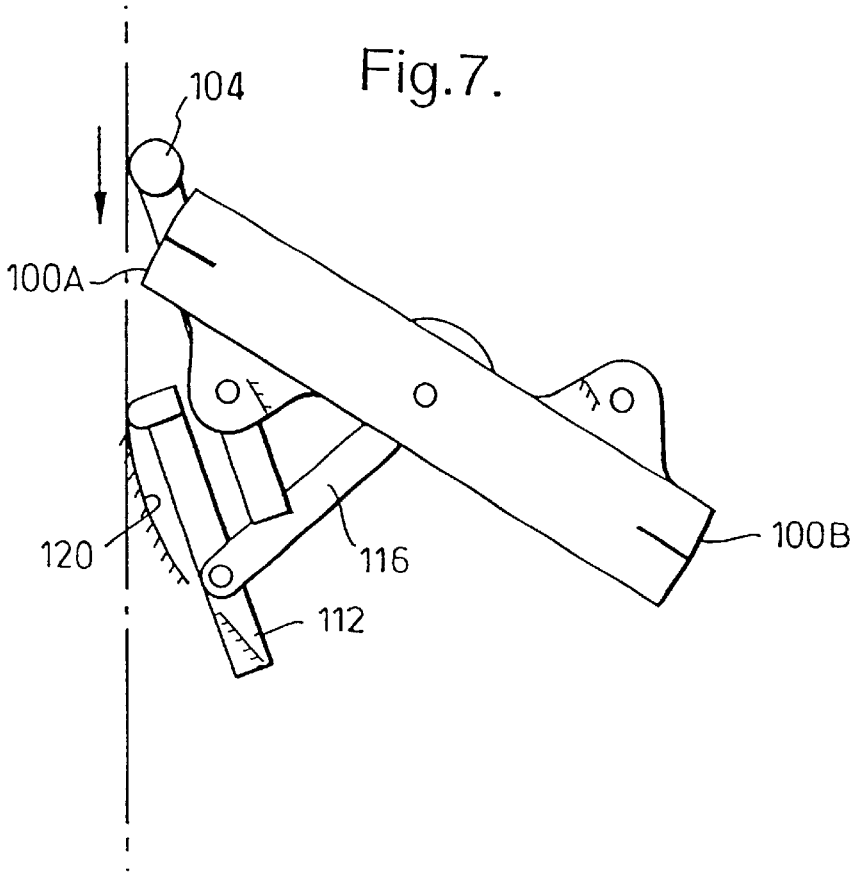

FIG. 7 shows the positions after 10° of further rotation of the sealing device and 20° of the stripper. Beyond this stage, there is no need for the stripper bars to engage the packaging material, and it is indeed undesirable for them to do so as they might damage the product in the just-formed bag. Each is accordingly guided away from the packaging material by a stationary cam 120. The arrangement is shown diagrammatically, and in practice each arm 112 would carry a follower roller or wheel arranged to run along the corresponding cam. A continuation of the cam may be provided to control the return of the stripper to its outermost position in preparation for its next stripping operation in association, this time, with the sealing jaw 100B.

Figure 8:
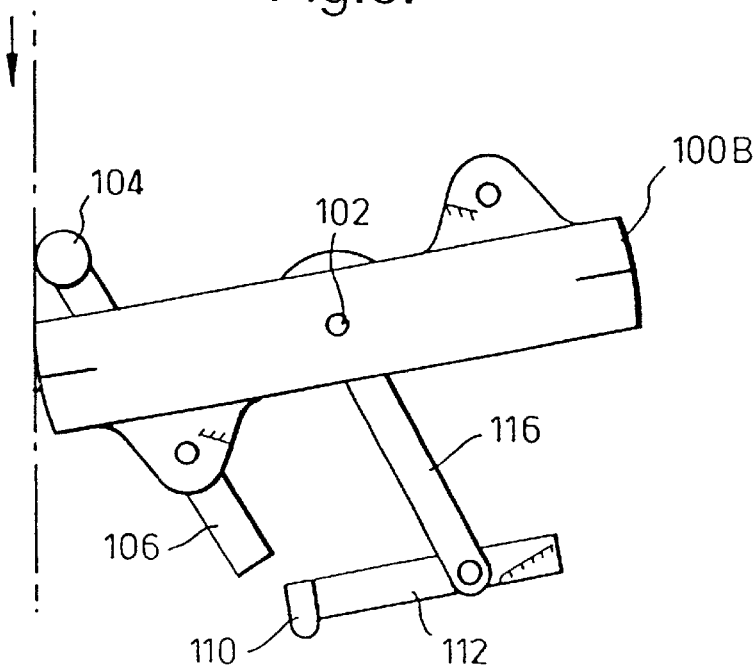

FIG. 8 shows the arrangement at the completion of sealing, a namely after 20° of further rotation of the sealing device and 40° of the stripper.

In the arrangement shown in FIGS. 5 to 8, the strippers may be driven at a set speed twice that of the sealing device, but are preferably driven by a servo motor so as to be capable of varying in speed, the average speed still being twice that of the sealing device.

The speed at which the packaging material 118 is driven downwards during bag formation is not necessarily constant. It may be varied cyclically as a result of being driven by a separate servo motor in order to optimise the machine operation. For example, the packaging material may be of a type which needs to be slowed down during sealing in order to achieve an adequate jaw contact (sealing) time, different packaging materials requiring different sealing times; moreover, the speed pattern between successive sealing operations needs to take into account the required bag length. At the stage shown by FIG. 7, the velocity of the packaging material may be increased so as to be greater than the downward velocity of the clamping rollers 104. This may be achieved by modulating the speed of the servo motor driving the web and/or by modulating the speed of the servo motor driving the sealing device.

FIGS. 9 to 12 show an arrangement which is similar in principle to that shown in FIGS. 5 to 8.

Figure 9:
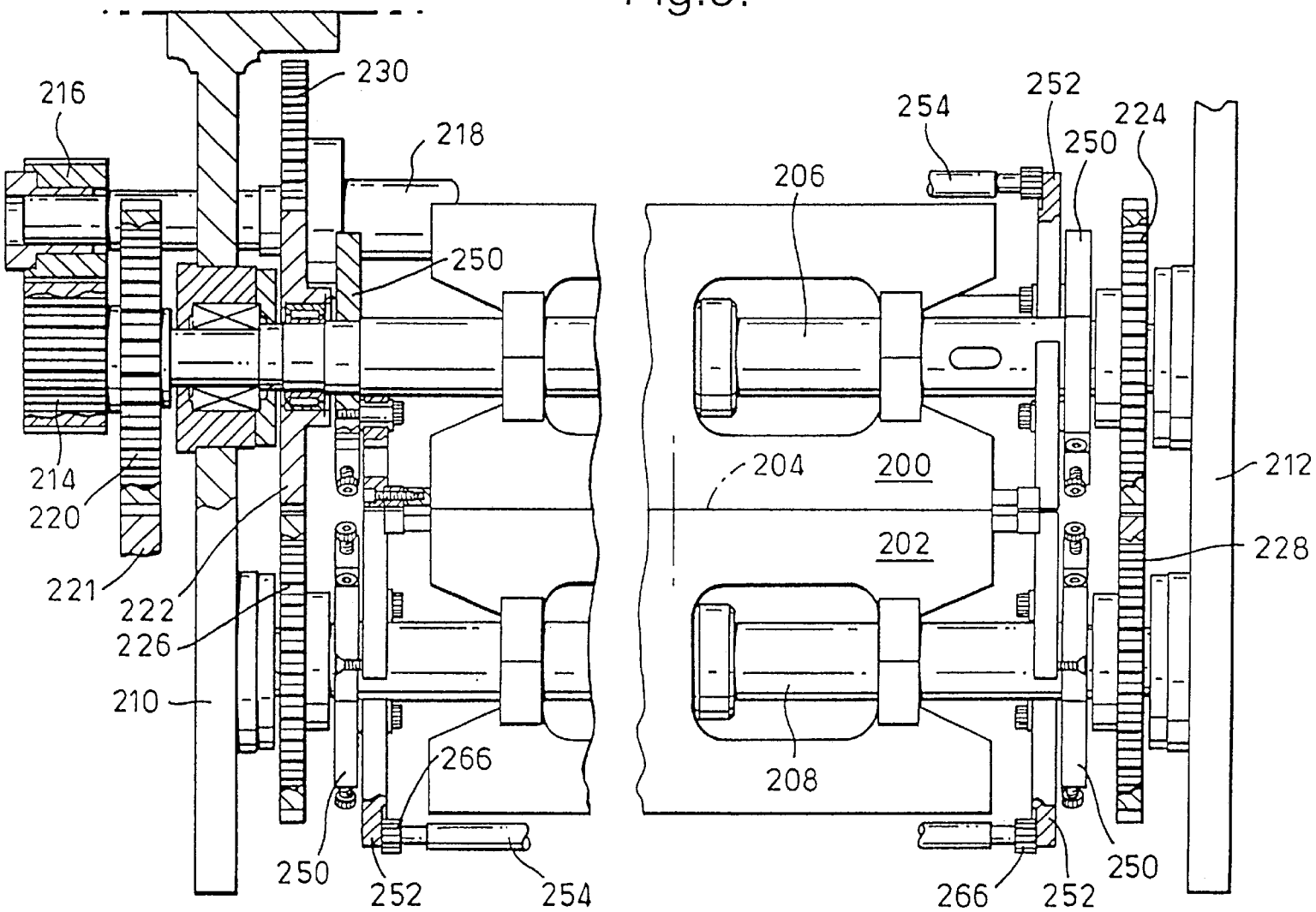
FIG. 9 is a plan view of another different machine.
Figure 11:
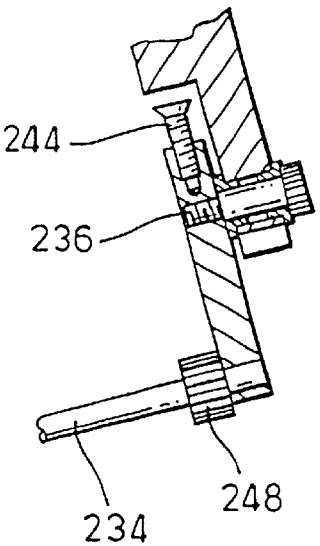
FIGS. 11 and 12 show details of the machine shown in FIG. 9.

FIG. 9 is a partly sectioned plan view and shows the two sealing devices 200 and 202 lying on opposite sides of a flattened tube of packaging material 204. The sealing devices are mounted respectively on shafts 206 and 208 carried by side frame members 210 and 212. A servo motor (not shown) drives the shafts in opposite directions and at equal speeds. For this purpose a double-sided timing belt (not shown) connects a pulley 214 on the shaft 206 with a similar pulley (not shown) on a shaft driven by the servo motor and with a pulley 216 (half the diameter of the other pulleys) on a further shaft 218. A gear 220 on the shaft 206 meshes with a similar gear 221 on the shaft 208.

Carrier members for the stripper bars are in the form of gears 222 and 224 for one stripper bar, and gears 226 and 228 for the other stripper bar. These gears are all identical; gears 222 and 226 mesh with one another, and likewise gears 224 and 228. Each of these gears is rotatably mounted by means of a bearing around one end of one of the shafts 206, 208. A gear 230 on the shaft 218 (of the same diameter as the gears 222,226 etc) meshes with the stripper-carrying gear 222, and a similar gear (not shown) on the shaft 218 meshes with the gear 224 so as to drive the stripper-carrying gears at twice the speed of the shafts 206 and 208.

Figure 10:
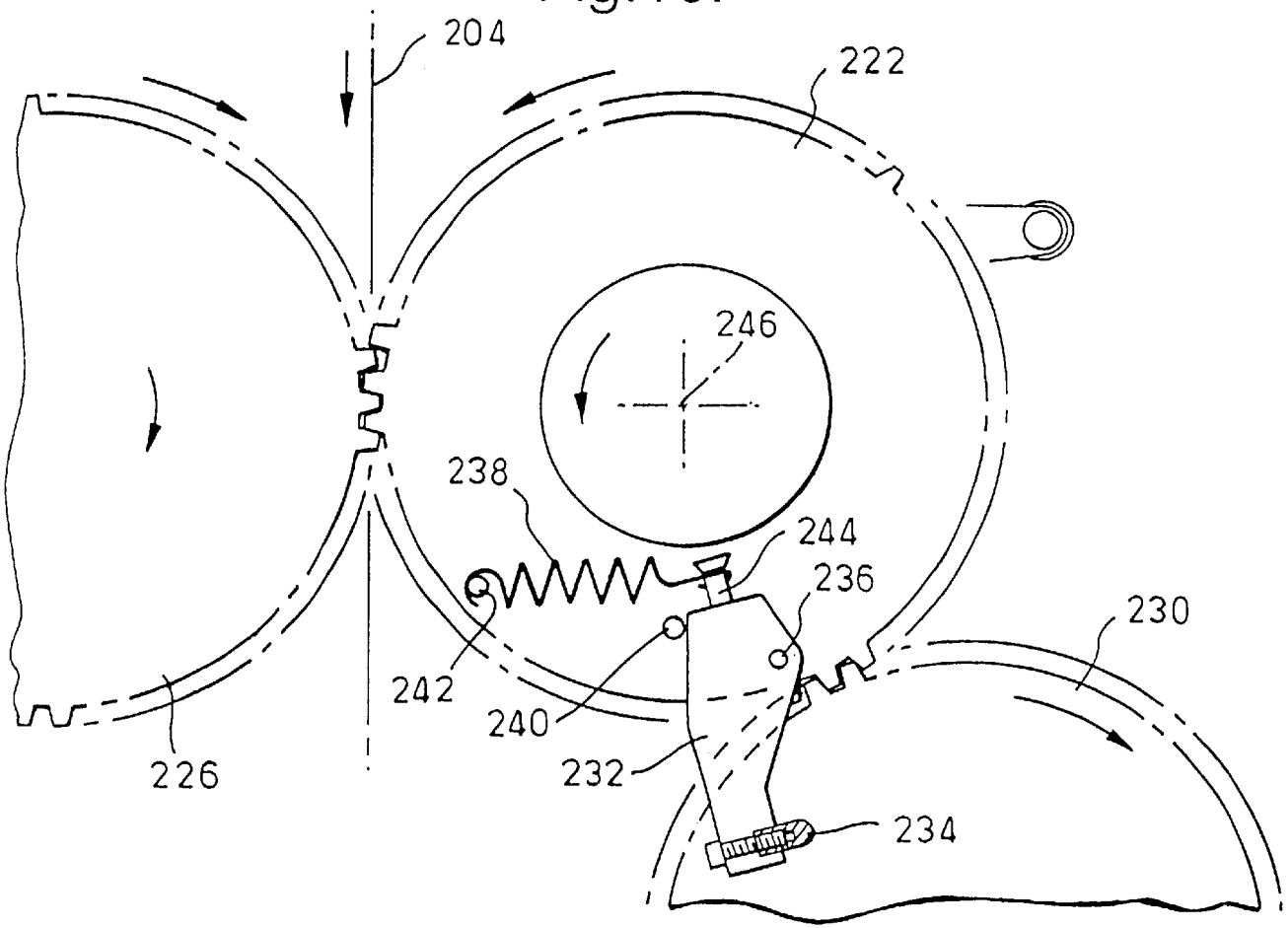
FIG. 10 is a fragmentary side view of the machine shown in FIG. 9.

FIG. 10 shows some detail associated with one of the stripper-carrying gears 222. It shows one of the stripper-carrying arms 232 which supports and drives one end of a stripper bar 234. The arm 232 is pivoted to the gear 222 on a pin 236 and is urged in an anti-clockwise direction about the pin 236 by a spring 238 which pulls the adjacent part of the arm 232 against a stop 240. Opposite ends of is the spring 238 are anchored respectively to a pin 242 on the gear 230 and to a screw 244 on the arm 232.

It will be understood therefore that FIG. 10 shows the stripper bar 234 in its outermost position. At this radius from the axis of rotation 246 of the gear, it can pass the corresponding sealing jaws and clamping rollers prior to performing a stripping operation in co-operation with a similar stripping bar (not shown) carried by the gear 226. On engaging the packaging material 204, each stripper rotates about its pivot 236, against the action of the spring 238, as will be understood by reference to the example shown in FIGS. 5 to 8.

It is necessary to ensure alignment of the cooperating stripper bars as they move downwards along the packaging material. For that purpose, each stripper bar carries, at each end, a fixed gear segment 248 (see FIG. 11) which meshes with a similar gear segment on the opposing stripper bar.

At each end of each of the shafts 206,208 (FIG. 9) there is a clamping roller carrying arrangement comprising a member 250 which is clamped to the shaft and which carries two pivoted arms 252 (see FIG. 12) supporting the ends of the clamping rollers 254. The clamping rollers may in fact comprise rods each of which is surrounded by a rotatable sleeve serving as a roller for engaging the packaging material in a rolling manner.

Figure 12:
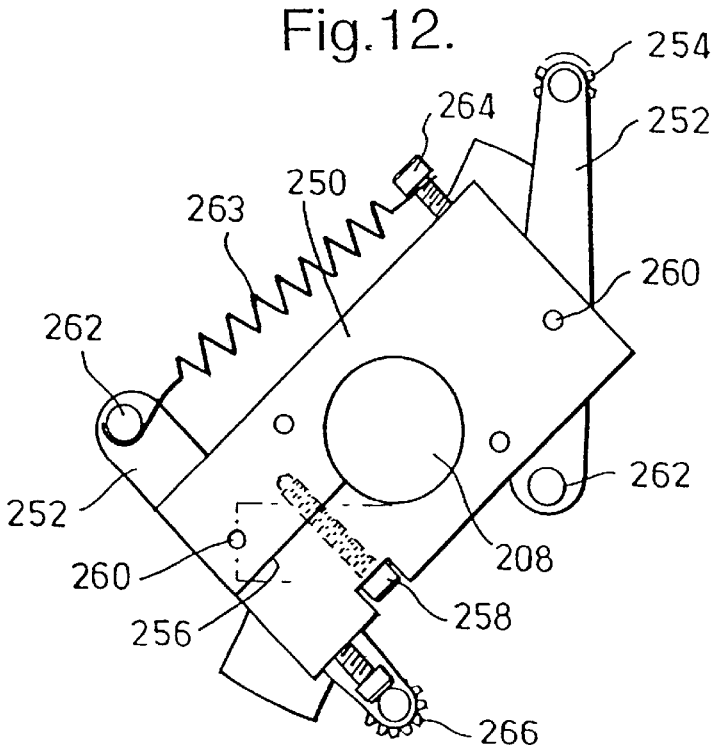

FIG. 12 shows the arrangement of one of the members 250 with the associated pivoted arms 252. The member 250 has a slot 256 which is closed by a clamping screw 258 to clamp the member 250 on the shaft 208 (in this example). Each arm 252 is pivoted to the member 250 by a pin 260 and has an eye 262 at one end (opposite to the clamping rod 254) for engagement by one end of a tension spring 263 of which the other end is secured to a screw 264.

At the end which supports the clamping roller, each arm 252 carries a fixed gear segment 266 for engaging a corresponding gear segment on the opposed clamping roller arrangement to ensure registration, as in the case of the stripper bars.

The phase relationship of the clamping rollers with respect to the sealing jaws can be adjusted slightly by undoing the clamping screws 258, rotating the members 250 about the shafts, and then tightening the screws 258. Also, and more importantly, the phase relationship of the stripper bars with respect to the sealing jaws can be adjusted within the drive transmission to the stripper carrier gears. Alternatively, it will be understood that the stripper carrier gears may be driven by a separate servo motor; this would enable the speed pattern (including the rotational phase) of the strippers to be varied independently of the sealing jaws, though the average speed of the strippers would still be twice that of the shafts carrying the sealing jaws.

Figure 13:
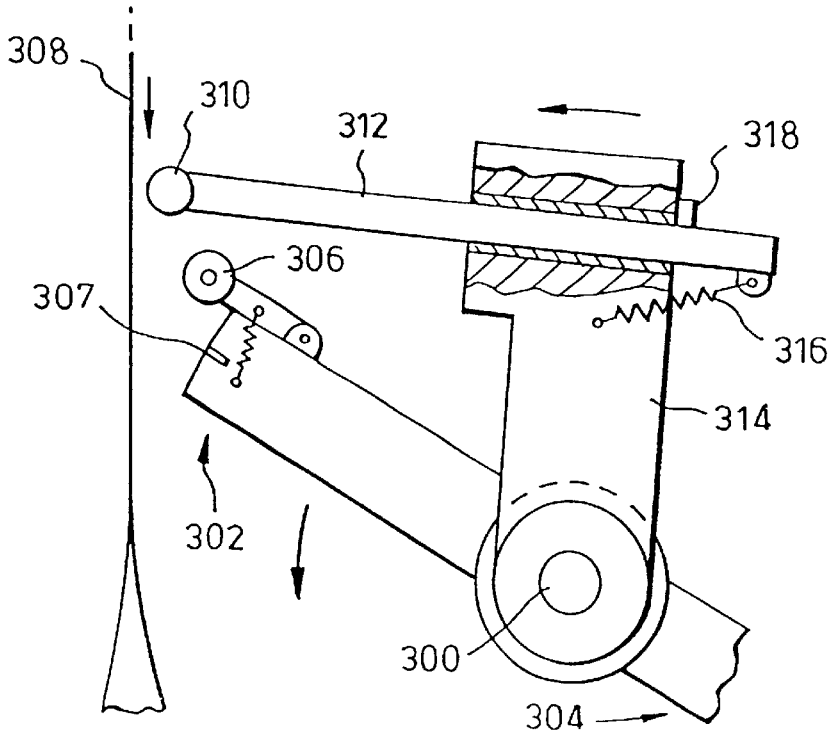
FIG. 13 is a diagrammatic representation of another different machine.

FIG. 13 shows diagrammatically another different form of machine according to this invention. A shaft 300 carries two sealing jaws 302 and 304 spaced apart by 180°, each carrying a pivotally mounted clamping roller 306 and including cutting means 307. A mirror-image arrangement (not shown) lies on the opposite side of a vertically moving flattened tube of packaging material 308.

A single stripper bar 310 is mounted at its ends on two rods 312 which are telescopically (slidably) carried by stripper carriers 314 which are rotatable about the axis of the shaft 300 and are driven at twice the speed of the shaft 300 or at an average of twice the speed if the stripper carriers are driven by an independent servo motor. A spring 316 urges the stripper bar outwards, its limiting outward position (as shown) being determined by stops 318 on the rods 312.

FIG. 13 shows the arrangement as the stripper bar 310 is about to contact the packaging material and then perform a stripping operation (in cooperation with the stripper bar on the other side of the packaging material) while passing the clamping roller and the sealer. The clamping rollers will reach the packaging material shortly after the area which they contact has been stripped by the stripper bars, which area is thus ensured to be product free.

As in the previous two examples, the stripper bars may, shortly after passing the sealers, be displaced from the packaging material by stationary cams.

As an alternative to the gear segments 248 for maintaining registration of the stripper bars, the following arrangement may be provided: recessed portions of the stripper bars, at or near the ends of the bars, are arranged to engage and slide along two vertical rods. That is to say, the cooperating stripper bars, in the regions of their ends, slide along opposite sides of the two rods which thus ensure that the stripper bars remain in register with one another while performing each stripping operation. A similar provision may be made for the clamping members.

What is claimed is:

1. A packaging machine for forming downwardly moving packaging material into bags containing product, comprising a pair of sealing jaws mounted directly or indirectly on parallel shafts for rotation in opposite directions on opposite sides of the path of the packaging material so that the jaws engage the packaging material simultaneously on opposite sides to form successive horizontal seals, and stripping means comprising, in association with the sealing jaw on each side of the path of the packaging material, a pair of stripper carriers mounted for rotation around the corresponding shaft at or near the respective ends thereof, or about an axis parallel to the shaft, a horizontal stripper bar mounted at its respective ends on the two stripper carriers and arranged to be movable with respect to the stripper carriers so that the stripper bar can engage the packaging film along a predetermined vertical stripping path along which, in cooperation with a similar stripper bar associated with the sealing jaw on the other side of the packaging material, it acts to displace downwards any product which might otherwise be trapped in the area of the seal, the stripper carriers being arranged to be rotated faster than the shafts at least while the stripper bars are performing each stripping operation, wherein the stripper bar moves at a greater angular velocity than the corresponding sealing jaw as it approaches the packaging material in preparation for performing a stripping operation.

2. A machine according to claim 1, in which each sealing jaw carries behind it a movably mounted clamping member arranged, in cooperation with an opposed clamping member on the other side of the packaging material, to prevent product from falling past it and into the area which is about to be sealed or has just been sealed by the cooperating opposed sealing jaws, and in which each stripper bar is arranged by virtue of its speed and position to pass the corresponding clamping member and to engage the packaging material to commence a stripping operation before the clamping member reaches the packaging material, thereby stripping also the area about to be engaged by the clamping member.

3. A machine according to claim 1, in which each shaft carries two sealing jaws 180 degrees apart from one another, and the stripper carriers on each side of the packaging material carry just one stripper bar and are driven at a speed or average speed twice that of the shafts.

4. A machine according to claim 1, in which the shafts are driven by a servo motor and the stripper carriers are driven by a separate servo motor.

5. A machine according to claim 4, in which the servo motor driving the stripper carriers is controllable as to its speed and/or phase, whereby the stripping operation with respect to its speed and/or timing can be adjusted while the machine is running.

6. A machine according to claim 1, in which each stripper bar is mounted at its ends on arms which are pivotally or slidably mounted on the corresponding stripper carriers.

7. A packaging machine, comprising two cooperating sealing devices each comprising at least one sealing jaw driven by a shaft so as to move continuously along a closed path, and each sealing device having an associated stripper bar pivotally or otherwise movably mounted and its ends on two rotating carrier members arranged to be driven continuously at a speed which is greater than that of the shaft at least while performing each stripping operation, the stripper bar moves along a closed path extending around the path of the sealing jaw or jaws at a greater angular velocity than the corresponding sealing jaw as it approaches the packaging material and having a straight portion extending along the packaging material to perform successive stripping operations in cooperation with a similarly movable stripper on the other side of the packaging material.

8. A machine according to claim 7, in which each sealing device comprises two oppositely disposed sealing jaws and in which the stripping means associated with each sealing means comprises a single stripper bar which is driven by the carrier members at a set or average speed twice that of the of the associated sealing means.

9. A machine according to claim 8, including means for resiliently urging the stripper bar away from the axis of rotation of the corresponding carrier members, whereby the stripper bar lies at a large enough radius to be able to overtake each sealing jaw in preparation for performing a stripping operation.

10. A machine according to claim 9, including means for guiding the stripper bar away from the packaging material after the completion of each stripping operation.

11. A machine according to claim 7, in which the carrier members for each stripper bar are mounted on end portions of the shaft of the corresponding sealing device for rotation relative to the shaft.

12. A packaging machine for forming downwardly moving packaging material into bags containing product, comprising a pair of sealing jaws mounted directly or indirectly on parallel shafts for rotation in opposite directions on opposite sides of the path of the packaging material so that the jaws engage the packaging material simultaneously on opposite sides to form successive horizontal seals, and stripping means comprising, in association with the sealing jaw on each side of the path of the packaging material, a pair of stripper carriers mounted for independent and continuous rotation on the corresponding shaft at or near the respective ends thereof, or about an axis parallel to the shaft, a horizontal stripper bar mounted at its respective ends on the two stripper carriers and arranged to be movable with respect to the stripper carriers so that the stripper bar can engage the packaging film along a predetermined vertical stripping path along which, in cooperation with a similar stripper bar associated with the sealing jaw on the other side of the packaging material, it acts to displace downwards any product which might otherwise be trapped in the area of the seal, the stripper carriers being arranged to be driven at a rotational speed faster than the rotational speed of the shafts at least while the stripper bars are performing each stripping operation, wherein the stripper bar moves at a greater angular velocity than the corresponding sealing jaw as it approaches the packaging material in preparation for performing a stripping operation.

13. A machine according to claim 12, in which each sealing jaw carries behind it a movably mounted clamping member arranged, in cooperation with an opposed clamping member on the other side of, the packaging material, to prevent product from falling past it and into the area which is about to be sealed or has just been sealed by the cooperating opposed sealing jaws, and in which each stripper bar is arranged by virtue of its speed and position to pass the corresponding clamping member and to engage the packaging material to commence a stripping operation before the clamping member reaches the packaging materials thereby stripping also the area about to be engaged by the clamping member.

14. A machine according to claim 12, in which each shaft carries two sealing jaws 180 degrees apart from one another, and the stripper carriers on each side of the packaging material carry just one stripper bar and are driven at a speed or average speed twice that of the shafts.

15. A machine according to claim 12, in which the shafts are driven by a servo motor and the stripper carriers are driven by a separate servo motor.

16. A machine according to claim 15, in which the servo motor driving the stripper carriers is controllable as to its speed and/or phase, whereby the stripping operation with respect to its speed and/or timing can be adjusted while the machine is running.

17. A machine according to claim 12, in which each stripper bar is mounted at its ends on arms which are pivotally or slidably mounted on the corresponding stripper carriers.

* * * * *